US008615391B2

(12) United States Patent
Kim et al.

(10) Patent No.: US 8,615,391 B2
(45) Date of Patent: Dec. 24, 2013

(54) METHOD AND APPARATUS TO EXTRACT IMPORTANT SPECTRAL COMPONENT FROM AUDIO SIGNAL AND LOW BIT-RATE AUDIO SIGNAL CODING AND/OR DECODING METHOD AND APPARATUS USING THE SAME

(75) Inventors: Junghoe Kim, Seoul (KR); Eunmi Oh, Seongnam-si (KR); Konstantin Osipov, St. Petersburg (RU); Boris Kudryashov, St. Petersburg (RU)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1303 days.

(21) Appl. No.: 11/480,897

(22) Filed: Jul. 6, 2006

(65) Prior Publication Data

US 2007/0016404 A1 Jan. 18, 2007

(30) Foreign Application Priority Data

Jul. 15, 2005 (KR) ..... 10-2005-0064507

(51) Int. Cl.
*G10L 19/00* (2013.01)

(52) U.S. Cl.
USPC ..... 704/200.1; 704/503; 704/233; 704/230; 704/229; 704/207; 704/205; 704/204; 704/203; 381/2; 370/203

(58) Field of Classification Search
USPC ..... 704/203, 200.1, 233, 2, 230, 229, 204, 704/503, 207, 205; 381/2; 370/203
See application file for complete search history.

(56) References Cited

U.S. PATENT DOCUMENTS 5,285,498 A * 2/1994 Johnston ..... 381/2
5,537,510 A * 7/1996 Kim ..... 704/229

(Continued)

FOREIGN PATENT DOCUMENTS

JP 07-183818 7/1995
JP 08-256064 10/1996

(Continued)

OTHER PUBLICATIONS

PCT Search Report dated Oct. 12, 2006 issued in PCT/KR2006/002775.

(Continued)

*Primary Examiner* — Michael Colucci
(74) *Attorney, Agent, or Firm* — Stanzione & Kim, LLP

(57) ABSTRACT

An method and apparatus to extract an audio signal having an important spectral component (ISC) and a low bit-rate audio signal coding/decoding method using the method and apparatus to extract the ISC. The method of extracting the ISC includes calculating perceptual importance including an SMR (signal-to-mask ratio) value of transformed spectral audio signals by using a psychoacoustic model, selecting spectral signals having a masking threshold value smaller than that of the spectral audio signals using the SMR value as first ISCs, and extracting a spectral peak from the audio signals selected as the ISCs according to a predetermined weighting factor to select second ISCs. Accordingly, the perceptual important spectral components can be efficiently coded so as to obtain high sound quality at a low bit-rate. In addition, it is possible to extract the perceptual important spectral component by using the psychoacoustic model, to perform coding without phase information, and to efficiently represent a spectral signal at a low bit-rate. In addition, the methods and apparatus can be employed in all the applications requiring a low bit-rate audio coding scheme and in a next generation audio scheme.

36 Claims, 6 Drawing Sheets

(56) References Cited

U.S. PATENT DOCUMENTS

| | | | | |
|---|---|---|---|---|
| 5,625,743 | A * | 4/1997 | Fiocca | 704/205 |
| 5,649,053 | A | 7/1997 | Kim | |
| 5,684,922 | A * | 11/1997 | Miyakawa et al. | 704/229 |
| 5,706,009 | A | 1/1998 | Kondo et al. | |
| 5,706,392 | A * | 1/1998 | Goldberg et al. | 704/200.1 |
| 5,721,806 | A * | 2/1998 | Lee | 704/229 |
| 5,790,759 | A * | 8/1998 | Chen | 704/200.1 |
| 5,886,276 | A | 3/1999 | Levine et al. | |
| 5,950,156 | A * | 9/1999 | Ueno et al. | 704/200.1 |
| 5,956,674 | A * | 9/1999 | Smyth et al. | 704/200.1 |
| 5,974,380 | A * | 10/1999 | Smyth et al. | 704/229 |
| 5,987,407 | A * | 11/1999 | Wu et al. | 704/200.1 |
| 6,023,674 | A * | 2/2000 | Mekuria | 704/233 |
| 6,092,041 | A * | 7/2000 | Pan et al. | 704/229 |
| 6,266,644 | B1 * | 7/2001 | Levine | 704/503 |
| 6,298,322 | B1 | 10/2001 | Lindemann | |
| 6,308,150 | B1 * | 10/2001 | Neo et al. | 704/200.1 |
| 6,330,531 | B1 * | 12/2001 | Su | 704/204 |
| 6,351,730 | B2 * | 2/2002 | Chen | 704/229 |
| 6,771,777 | B1 | 8/2004 | Gbur et al. | |
| 7,398,204 | B2 * | 7/2008 | Najaf-Zadeh et al. | 704/207 |
| 7,640,157 | B2 * | 12/2009 | Prakash et al. | 704/230 |
| 2002/0116179 | A1 * | 8/2002 | Watanabe | 704/200.1 |
| 2002/0176353 | A1 * | 11/2002 | Atlas et al. | 370/203 |
| 2003/0233234 | A1 | 12/2003 | Truman et al. | |
| 2004/0088160 | A1 * | 5/2004 | Manu | 704/203 |
| 2005/0015249 | A1 * | 1/2005 | Mehrotra et al. | 704/230 |
| 2006/0069555 | A1 * | 3/2006 | Konda et al. | 704/229 |

FOREIGN PATENT DOCUMENTS

| | | |
|---|---|---|
| JP | 09-214346 | 8/1997 |
| JP | 10-301594 | 11/1998 |
| JP | 2000505266 | 4/2000 |
| JP | 2001-282290 | 10/2001 |
| JP | 2003-177797 | 6/2003 |
| KR | 1994-1115 | 2/1994 |
| KR | 2002-77959 | 10/2002 |
| WO | 00/39790 | 7/2000 |
| WO | 03/107328 | 12/2003 |

OTHER PUBLICATIONS

Korean Office Action dated Aug. 20, 2007 issued in KR 2005-64507.
Purnhagen H. et al., "Sinusoidal Coding Using Loudness-Based Component Selection", In: Acoustics Speech, and Signal Processing, 2002, Proceedings. (ICASSP '02), IEEE International Conference on May 13, 2002, pp. 1817-1820.
Korean Office Action dated Sep. 25, 2006 issued in KR 2005-64507.
"Exploiting Time and Frequency Masking in Consistent Sinusoidal Analysis-Synthesis," Renat et al., IEEE, 2000 (pp. 901-904).
"Spectrum Estimation and Harmonic Analysis," David J. Thomson, Proceedings of IEEE, 1982.9 (pp. 1055-1096).
Extended European Search Report issued Jan. 26, 2010 in EP Application No. 06823588.6.
Van Schijndel N H et al: "Towards a better balance in sinusoidal plus stochastic representation" Applications of Signal Processing to Audio and Acoustics, 2003 IEEE Workshop on. New Paltz, NY USA Oct. 19-22, 2003, Piscataway, NJ, USA, IEEE, Oct. 19, 2003, pp. 197-200, XP010697936 ISBN: 978-0-7803-7850-6.
Mark Fek et al: "Joint Speech and Audio Coding Combining Sinusoidal Modeling and Wavelet Packets" Eurospeech 2001, vol. 4, Sep. 3, 2001, Sep. 7, 2001 pp. 2311-2314, XP007004852 * section 3: "Sinusoidal Modeling" *.
Purnhagen H et al: "Sinusoidal coding using loudness-based component selection" 2002 IEEE International Conference on Acoustics, Speech, and Signal Processing. Proceedings. (ICASSP). Orlando, FL, May 13-17, 2002; [IEEE International Conference on Acoustics, Speech, and Signal Processing (ICASSP)], New York, NY : IEEE, US, vol. 2, May 13, 2002, pp. II-1817, XP010804249.
Najafzadch H et al: "Perceptual bit allocation for low rate coding of narrowband audio" Acoustics, Speech, and Signal Processing, 2000. ICSASSP ' 00. Proceedings. 2000 IEEE International Conference on Jun. 5-9, 2000, Piscataway, NJ, USA, IEEE, vol. 2, Jun. 5, 2000, pp. 893-896, XP010504867 ISBN: 978-0-7803-6293-2.
Chinese Office Action issued Aug. 11, 2010 in CN Application No. 200680025920.2.
Yanfei Ma, Study of MPEG Audio Layer III Coding Algorithm and Its Hardware Implementation, Xidian University, Master's Degree Thesis, Thesis Submitted Jan. 15, 2005.
Japanese Office Action 2008-521328 issued Jan. 11, 2011.
CN Office Action issued Aug. 9, 2011 in CN Patent Application No. 200680025920.2.
"Exploiting Time and Frequency Masking in Consistent Sinusoidal Analysis-Synthesis", Renat Vafin et al. IEEE international COnference on Acoustics, Speech, and Signal Processing, 2000, vol. 2, Jun. 9, 2000.
Chinese Office Action Issued on Apr. 13, 2012 in CN Patent Application No. 200680025920.2.
European Office Action Issued on May 10, 2012 in EP Patent Application No. 06823588.6.
"Speech Enhancement Using a Constrained Iterative Sinusoidal Model", Jesper Jensen et al., IEEE Transactions on Speech and Audio Processing, vol. 9, No. 7; Oct. 2001, pp. 731-740.
Extended European Search Report dated Nov. 22, 2012 issued in EP Application No. 12003918.5.
Venna T S et al: "A 6KBPS to 85KBPS scalable audio coder" Acoustics, Speech, and Signal Processing, 2000. ICASSP '00. Proceeding S. 2000 IEEE International Conference on Jun. 5-9, 2000, Piscataway, NJ, USA, IEEE, vol. 2, Jun. 5, 2000, pp. 877-880, XP010504863, ISBN: 978-0-7803-6293-2 *p. 879, left-hand column* *figures 2,3* *Sec. 3: "Decoder Overview"*.
Japanese Office Action dated Jun. 25, 2013 issued in JP Application No. 2012-118574.

* cited by examiner

METHOD AND APPARATUS TO EXTRACT IMPORTANT SPECTRAL COMPONENT FROM AUDIO SIGNAL AND LOW BIT-RATE AUDIO SIGNAL CODING AND/OR DECODING METHOD AND APPARATUS USING THE SAME

CROSS-REFERENCE TO RELATED APPLICATIONS

This application claims the benefit of Korean Patent Application No. 10-2005-0064507, filed on Jul. 15, 2005, in the Korean Intellectual Property Office, the disclosure of which is incorporated herein in its entirety by reference.

BACKGROUND OF THE INVENTION

1. Field of the Invention

The present general inventive concept relates to an audio signal coding and/or decoding system, and more particularly, to a method and apparatus to extract an important spectral component of an audio signal and a method and apparatus to code and decode a low bit-rate audio signal using the same.

2. Description of the Related Art

"MPEG (Moving Picture Experts Group) audio" is an ISO/IEC standard for high-quality high-performance stereo coding. The MPEG audio is standardized together with moving picture coding in accordance with ISO/IEC SC29/WG11 of MPEG. For the MPEG audio, sub-band coding (band division coding) based on 32 bands and modified discrete cosine transform (MDCT) are used for compression, and in particularly, a high performance compression is performed by using psychopathic characteristics. The MPEG audio can implement a high quality of sound compared to a conventional compression coding scheme.

In order to compress audio signals with a high performance, the MPEG audio utilizes a "perceptual coding" compression scheme in which detailed low sensitive information is eliminated by using sensitive characteristics of human beings sensing audible signals, to reduce a code amount of the audio signals.

In addition, in the MPEG audio, a minimum audible limit and a masking property of a silent period are mainly used for the perceptual coding using an auditory psychopathic characteristic. The minimum audible limit of a silent period is a minimum level of sound which can be perceived by auditory sense. The minimum audible limit is related to a limit of noise which can be perceived by the auditory sense in the silent period. The minimum audible limit varies according to frequencies of sound. At some frequencies, sound higher than the minimum audible limit may be audible, but at other frequencies, sound lower than the minimum audible limit may not be audible. In addition, a sensing limit of a specific sound may varies greatly according to other sounds which are heard together with the specific sound. This is called "masking effect." A width of a frequency at which the masking effect occurs is called a critical band. In order to efficiently use the auditory psychopathic characteristics such as the critical band, it is important to decompose the sound signal into spectral components. For the reason, the band is divided into 32 sub-bands, and then, the sub-band coding is performed. In addition, in the MPEG audio, filter banks are used to eliminate aliasing noises of the 32 sub-bands.

The MPEG audio includes bit allocation and quantization using filter banks and a psychoacoustic model. Coefficients generated from the MDCT are allocated with optimal quantization bits and compressed by using a psychoacoustic model 2. The psychoacoustic model 2 for allocating the optimal bits evaluates the masking effect based on FFT by using spreading functions. Therefore, a relatively large amount of complexity is required.

In general, for the compression of the audio signals with a low bit-rate (32 kbps or less), the number of bits which can be allocated to the signals is insufficient for quantization of all spectral components of the audio signal and lossless coding thereof. Therefore, there is a need for extraction of perceptively importance spectral components (ISCs) and quantization and lossless coding thereof.

SUMMARY OF THE INVENTION

The present general inventive concept provides a method and apparatus to extract an important spectral component from an audio signal to compress the audio signal with a low bit-rate.

The present general inventive concept also provides a low bit-rate audio signal coding method and apparatus using a method and apparatus to extract an important spectral component from an audio signal.

The present general inventive concept also provides a low bit-rate audio signal decoding method and apparatus to decode a low bit-rate audio signal coded by the low bit-rate audio signal coding method and apparatus Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a method of extracting important spectral components (ISCs) of audio signals, the method comprising calculating perceptual importance including a signal-to-mask ratio (SMR) value of transformed spectral audio signals by using a psychoacoustic model, selecting the spectral audio signals having a masking threshold value smaller than that of the spectral audio signals using the SMR value as first ISCs, and extracting a spectral peak from the spectral audio signals selected as the first ISCs according to a predetermined weighting factor to select second ISCs. The weighting factor may be obtained by using a predetermined number of spectrum values near a frequency of a current signal of which weighting factor is to be obtained.

The method may further include obtaining SNRs (signal-to-noise ratios) for frequency bands and selecting spectral components of which peak values are larger than a predetermined value among the frequency bands having a low SNR as the ISCs.

The foregoing and/or other aspects and advantages of the present general inventive concept may also be achieved by providing a method of extracting ISCs (important spectral components) of audio signals, the method comprising calculating perceptual importance including an SMR (signal-to-mask ratio) value of transformed spectral audio signals by using a psychoacoustic model, selecting the spectral audio signals having a masking threshold value smaller than that of the spectral audio signals using the SMR as first ISCs, and obtaining SNRs for frequency bands among the spectral audio signals selected as the first ISCs to select the spectral audio signals having spectral components of which peak values are larger than a predetermined value among the frequency bands having a low SNR using the SNRs as another ISCs.

The foregoing and/or other aspects and advantages of the present general inventive concept may also be achieved by providing a low bit-rate audio signal coding method comprising calculating perceptual importance including an SMR (signal-to-mask ratio) value of spectral audio signals by using a psychoacoustic model, selecting the spectral audio signals having a masking threshold value smaller than that of the spectral audio signals using the SMR value as first ISCs, extracting a spectral peak from the audio signals selected as the first ISCs according to a predetermined weighting factor, and selecting the spectral audio signals having a frequency of the spectral peak as a second ISC, and performing quantization and lossless coding on the spectral audio signals having the second ISC. The extracting of the spectral peak may comprise obtaining SNRs (signal-to-noise ratios) for frequency bands and selecting spectral components of which peak values are larger than a predetermined value among the frequency bands having a low SNR using the SNRs as third ISCs. The low bit-rate audio signal coding method may further comprise transforming a temporal audio signal into the spectral audio signal by using MDCT (modified discrete cosine transform) and MDST (modified discrete sine transform) to generate the spectral audio signal. The performing of quantization of the ISC audio signal may comprise performing grouping the audio signals into a plurality of groups so as to minimize additional information according to a used bit amount and a quantization error, determining a quantization step size according to an SMR (signal-to-mask ratio) and data distribution of a dynamic range of the groups, and quantizing the audio signal by using one or more predetermined quantizers for the groups. The quantizers may be determined by using values normalized with a maximum value of the group and the quantization step size. The quantization may be a Max-Lloyd quantization.

The performing of the lossless coding of the quantized signal may comprise performing context arithmetic coding. The performing of the context arithmetic coding may comprise representing the spectral components constituting frames with spectral indexes indicating the presence of the ISCs, and selecting a stochastic model according to a correlation to a previous frame and distribution of neighboring ISCs to perform the lossless coding on quantization values of the audio signal, and additional information including the quantizer information, the quantization step, the grouping information, and the spectral index value.

The foregoing and/or other aspects and advantages of the present general inventive concept may also be achieved by providing a low bit-rate audio signal coding method comprising calculating perceptual importance including an SMR (signal-to-mask ratio) value of spectral audio signals by using a psychoacoustic model, selecting the spectral audio signals having a making threshold value smaller than that of the spectral audio signals using the SMR value as first ISCs, obtaining SNRs for frequency bands among the spectral audio signals selected as the first ISCs and selecting spectral components of which peak values are larger than a predetermined value among the frequency bands having a low SNR using the SNRs as another ISCs, and performing quantization and lossless coding on the spectral audio signals having the another ISCs.

The foregoing and/or other aspects and advantages of the present general inventive concept may also be achieved by providing an apparatus to extract an audio signal ISC (important spectral component), the apparatus comprising a psychoacoustic modeling unit which calculates perceptual importance including an SMR (signal-to-mask ratio) value of transformed spectral audio signals by using a psychoacoustic model, a first ISC selection unit which selects the spectral audio signals having a masking threshold value smaller than that of the spectral audio signals using the SMR as first ISCs, and a second ISC selection unit which extracts a spectral peak from the spectral audio signals selected as the first ISCs according to a predetermined weighting factor and selecting second ISCs. The weighting factor in the second ISC selection unit may be obtained by using a predetermined number of spectrum values near a frequency of a current signal of which weighting factor is to be obtained. The apparatus may further comprise a third ISC selection unit which obtains SNRs (signal-to-noise ratios) for frequency bands and selects spectral components of which peak values are larger than a predetermined value among the frequency bands having a low SNR using the SNRs as third ISCs.

The foregoing and/or other aspects and advantages of the present general inventive concept may also be achieved by providing an apparatus to extract an important spectral component (ISC) from an audio signal, the apparatus comprising a psychoacoustic modeling unit which calculates perceptual importance including an SMR (signal-to-mask ratio) value of transformed spectral audio signals by using a psychoacoustic model, a first ISC selection unit which selects the spectral audio signals having a masking threshold value smaller than that of the spectral audio signals using the SMR as first ISCs, and another ISC selection unit which obtains SNRs for frequency bands among the audio signals selected as the first ISCs and selects spectral components of which peak values are larger than a predetermined value among the frequency bands having a low SNR using the SNRs as another ISCs.

The foregoing and/or other aspects and advantages of the present general inventive concept may also be achieved by providing a low bit-rate audio signal coding extracting apparatus comprising a psychoacoustic modeling unit which calculates perceptual importance including an SMR (signal-to-mask ratio) value of transformed spectral audio signals by using a psychoacoustic model, a first ISC (important spectral component) selection unit which selects the spectral audio signals having a masking threshold value smaller than that of the spectral audio signals using the SMR as first ISCs, a second ISC selection unit which extracts a spectral peak from the spectral audio signals selected as the first ISCs according to a predetermined weighting factor and selecting second ISCs, a quantizer which quantizes the spectral audio signal having the second ISCs, and a lossless coder which performs lossless coding on the quantized signal.

The low bit-rate audio signal coding apparatus may further comprise a third ISC selection unit which obtains SNRs (signal-to-noise ratios) for frequency bands and selects spectral components of which peak values are larger than a predetermined value among the frequency bands having a low SNR using the SNRs as third ISCs.

The low bit-rate audio signal coding apparatus may further comprise a T/F transformation unit which transforms a temporal audio signal into the spectral audio signal by using MDCT (modified discrete cosine transform) and MDST (modified discrete sine transform).

The quantizer may comprise a grouping unit which performs grouping the spectral audio signals into a plurality of groups so as to minimize additional information according to a used bit amount and a quantization error, a quantization step size determination unit which determines a quantization step size according to an SMR (signal-to-mask ratio) and data distribution (dynamic range) of groups, and a group quantizer which quantizes the audio signal by using predetermined quantizers for the groups. The quantization of the group quantizer may be a Max-Lloyd quantization, and the lossless coding of the lossless coder may be context arithmetic coding.

The lossless coder may comprise an indexing unit which represents the spectral components constituting frames with spectral indexes indicating the presence of the ISCs, and a stochastic model lossless coder which selects a stochastic model according to a correlation to a previous frame and distribution of neighboring ISCs and performs the lossless coding on quantization values of the audio signal, and additional information including the quantizer information, the quantization step size, the grouping information, and the spectral index value.

The foregoing and/or other aspects and advantages of the present general inventive concept may also be achieved by providing a low bit-rate audio signal coding apparatus comprising a psychoacoustic modeling unit which calculates perceptual importance including an SMR (signal-to-mask ratio) value of transformed spectral audio signals by using a psychoacoustic model, a first ISC (important spectral component) selection unit which selects the spectral audio signals having a masking threshold value smaller than that of the spectral audio signals using the perceptual importance as first ISCs, another selection unit which obtains SNRs for frequency bands among the audio signals selected as the ISCs and selects spectral components of which peak values are larger than a predetermined value among the frequency bands having a low SNR using the SNRs as another ISCs, a quantizer which quantizes the spectral audio signal having the another ISCs, and a lossless coder which performs lossless coding on the quantized signal.

The foregoing and/or other aspects and advantages of the present general inventive concept may also be achieved by providing a low bit-rate audio signal decoding method comprising restoring index information indicating the presence of ISCs (importance spectral components), quantizer information, a quantization step size, ISC grouping information, and audio signal quantization values, performing inverse quantization with reference to the restored quantizer information, quantization step size, and grouping information, and transforming the inversely-quantized values to temporal signals.

The foregoing and/or other aspects and advantages of the present general inventive concept may also be achieved by providing a low bit-rate audio signal decoding apparatus comprising a lossless decoder which extracts stochastic model information for frames and restores index information indicating the presence of ISCs (importance spectral components), quantizer information, a quantization step size, ISC grouping information, and audio signal quantization values by using the stochastic model information, an inverse quantizer which performs inverse quantization with reference to the restored quantizer information, quantization step size, and grouping information, and an F/T transformation unit which transforms the inversely-quantized values to temporal signals.

The foregoing and/or other aspects and advantages of the present general inventive concept may also be achieved by providing a computer-readable medium having embodied thereon a computer program to perform a method comprising calculating perceptual importance including an SMR (signal-to-mask ratio) value of transformed spectral audio signals according to a psychoacoustic model, selecting spectral signals having a masking threshold value smaller than that of the spectral audio signals using the perceptual importance as one or more first important spectral components (ISCs), and extracting a spectral peak from the audio signals selected as the one or more first ISCs according to a predetermined weighting factor to select one or more second ISCs to be used to code the spectral audio signal.

The foregoing and/or other aspects and advantages of the present general inventive concept may also be achieved by providing a computer-readable medium having embodied thereon a computer program to perform a method comprising restoring index information indicating the presence of importance spectral components (ISCs), quantizer information, a quantization step size, ISC grouping information, and audio signal quantization values with respect to an audio signal, performing inverse quantization on the audio signal according to the restored quantizer information, quantization step size, and grouping information, and transforming the inversely-quantized signals to temporal signals.

The foregoing and/or other aspects and advantages of the present general inventive concept may also be achieved by providing audio signal coding and/or decoding system, comprising a coder to select spectral audio signals having one or more important spectral components (ISCs) according to a signal-to-mask ratio (SMR) value and one of a weighing factor and a signal-to-noise ratio (SNR) of a frequency band, and to code the spectral audio signals according to information on the selected ISCs, and a decoder to decode the coded spectral audio signals according to the information.

The foregoing and/or other aspects and advantages of the present general inventive concept may also be achieved by providing an audio signal coding and/or decoding system, comprising a coder to select spectral audio signals having one or more important spectral components (ISCs) according to a signal-to-mask ratio (SMR) value and one of a weighing factor and a signal-to-noise ratio (SNR) of a frequency band, and to code the spectral audio signals according to information on the selected ISCs.

The foregoing and/or other aspects and advantages of the present general inventive concept may also be achieved by providing an audio signal coding and/or decoding system comprising a decoder to decode the coded spectral audio signals according to information on ISCs. The ISC may be obtained according to a signal-to-mask ratio (SMR) value and one of a weighing factor and signal-to-noise ratios (SNRs) of frequency bands of spectral audio signals.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
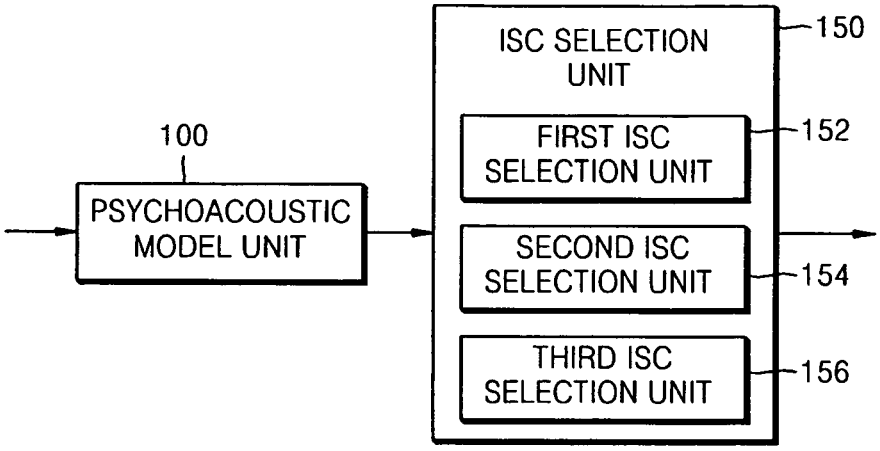
FIG. 1 is a block diagram illustrating an apparatus to extract an important spectral component from an input audio signal in order to compress the audio signal with a low bit-rate according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an apparatus to extract an important spectral component (ISC) from an input audio signal in order to compress the audio signal with a low bit-rate according to an embodiment of the present inventive concept. The audio signal ISC extraction apparatus includes a psychoacoustic modeling unit 100 and an ISC selection unit 150.

The psychoacoustic modeling unit 100 calculates a signal-to-mask ratio (SMR) value for a transformed spectral audio signal transformed according to psychoacoustic characteristics. The spectral audio signal input to the psychoacoustic modeling unit 100 is generated by using a modified discrete cosine transform (MDCT) and a modified discrete sine transform (MDST) instead of a discrete Fourier transform (DFT). Since the MDCT and the MDST represent real and imaginary parts of the audio signal, respectively, phase information of the audio signal can be represented. Therefore, a problem of mis-match between the DFT and the MDCT can be solved. The problem of the mis-match occurs when coefficients of the MDCT is quantized by using a temporal audio signal which is subject to the DFT.

The ISC selection unit 150 selects the ISC from the audio signal by using the SMR value. The ISC selection unit 150 includes first, second, and third ISC selectors 152, 154, and 156 to select one or more first, second, and third ISCs, respectively. The one or more first, second, and/or third ISCs can be referred to as the ISCs.

The first ISC selector 152 selects the one or more spectral signals having a masking threshold value smaller than that of the spectral audio signal as one or more first important spectral components (ISCs) by using the SMR value calculated by the psychoacoustic modeling unit 100.

The second ISC selector 154 selects the one or more second ISCs by extracting a spectral peak from the audio signals selected as the one or more first ISCs in the first ISC selector 152 according to a predetermined weighting factor.

The spectral peak is searched among the one or more first ISCs. The spectral peak is determined based on a size of a signal. The size of the signal is defined by the root of the square of a real part plus the square of an imaginary part of a signal subjected to transformation of the MDCT and MDST. The weighting factor of the signal is obtained by using a spectrum value near the signal. The weight factor in the second ISC selector 154 is obtained by using a predetermined number of spectrum values near a frequency of a current signal of which weighting factor is to be obtained. The weighting factor may be obtained by using Equation 1.

$$W_k = \frac{|SC_k|}{\sum_{t=k-len}^{k-1} |SC_i| + \sum_{j=k+1}^{k+len} |SC_j|} \quad \text{[Equation 1]}$$

Here, $|SC_k|$ denotes a size of the current signal of which weighting factor is to be obtained, and $|SC_i|$ and $|SC_j|$ denotes sizes of signals near the current signal. In addition, $I_{en}$ denotes the number of signals near the current signal.

The second ISCs are selected based on the peak value and the weighting factor of the signal. For example, a product of the peak value and the weighting factor is compared to a predetermined threshold value to select only values larger than the threshold value as the second ISCs.

The third ISC selector 156 performs signal to noise ratio (SNR) equalization on the audio signal. That is, spectral components of the audio signal are divided into frequency bands, and SNRs for frequency bands are obtained, and spectral components of which peak values are larger than a predetermined value among the frequency bands having a low SNR are selected as the one or more third ISCs. Such an operation is performed in order to prevent the ISCs from concentrating on a specific frequency band. In other words, dominant peaks are selected among the frequency bands having a low SNR, so that the SNRs of the frequency bands are approximately equalized over the entire frequency bands. As a result, the SNR values of the frequency bands having the low SNR increase, so that the SNR values of the entire frequency bands are approximately equalized.

The first, second, and third ISC selectors 152, 154, and 156 constituting the ISC selection unit 150 may selectively used to extract the audio signal having the perceptively important spectral components (ISCs). For example, only the first and second ISC selector 152 and 154 may be used. However, only the first and third ISC selectors 152 and 156 may be used. Otherwise, all the first to third selectors 152, 154, and 156 may be used. Accordingly, the first, second, and/or third ISCs can be extracted from the audio signal to be used as the ISCs so that the audio signal is compressed using the extracted ISCs in quantization of all spectral components of the audio signal and/or lossless coding thereof.

Figure 2:
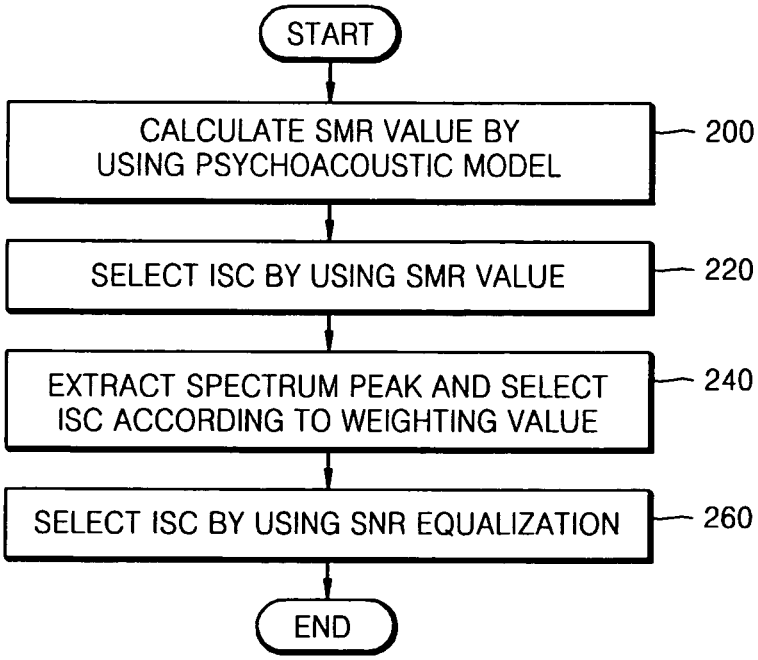
FIG. 2 is a flowchart illustrating a method of extracting an important spectral component from an input audio signal in order to compress the audio signal with a low bit-rate according to an embodiment of the present general inventive concept.

FIG. 2 is a flowchart illustrating a method of extracting an important spectral component of an audio signal according to an embodiment of the present general inventive concept in order to compress the audio signal with a low bit-rate. Referring to FIGS. 1 and 2, the SMR value of the audio signal transformed into a frequency region is calculated by using a psychoacoustic model (operation 200). Next, spectral signals of which masking threshold value is lower than the audio signal in the frequency region are selected as the first ISCs by using the SMR value (operation 220).

Spectral peaks are extracted from the audio signals selected as the first ISCs according to a predetermined weighting factor and selected as the second ISCs (operation 240). The weighting factor can be obtained by using spectrum values of predetermined frequencies near a frequency of a current signal of which weighting factor is to be obtained. Operation 240 may be the same as the operation of the aforementioned second ISC selector 154 of FIG. 1, and thus, description thereof is omitted.

The third ISCs for frequencies (or frequency bands) are selected by performing SNR equalization (operation 260). That is, the spectral components of the audio signal are divided into frequency bands, SNRs for frequency bands are obtained, and the spectral components of which peak values are larger than a predetermined value among the frequency bands having a low SNR are selected as the third ISCs. The first, second, and/or third ISCs may be collectively referred to as the ISCs. As described above, such an operation is performed in order to prevent the ISCs from concentrating on a specific frequency band. In other words, dominant peaks are selected among the frequency bands having the low SNR, so that the SNRs of the frequency bands are approximately equalized over the entire bands. As a result, the SNR values of the frequency bands having the low SNR increase, so that the SNR values of the entire bands are approximately equalized.

On the other hand, the ISC extraction in operations 220 to 260 may be selectively used. For example, only the operations 200 and 200 may be used to extract the ISCs. However, only the operations 200 and 260 may be used to extract the ISCs. Otherwise, all the operations 200, 240, and 260 may be used to extract the ISCs.

Figure 3:
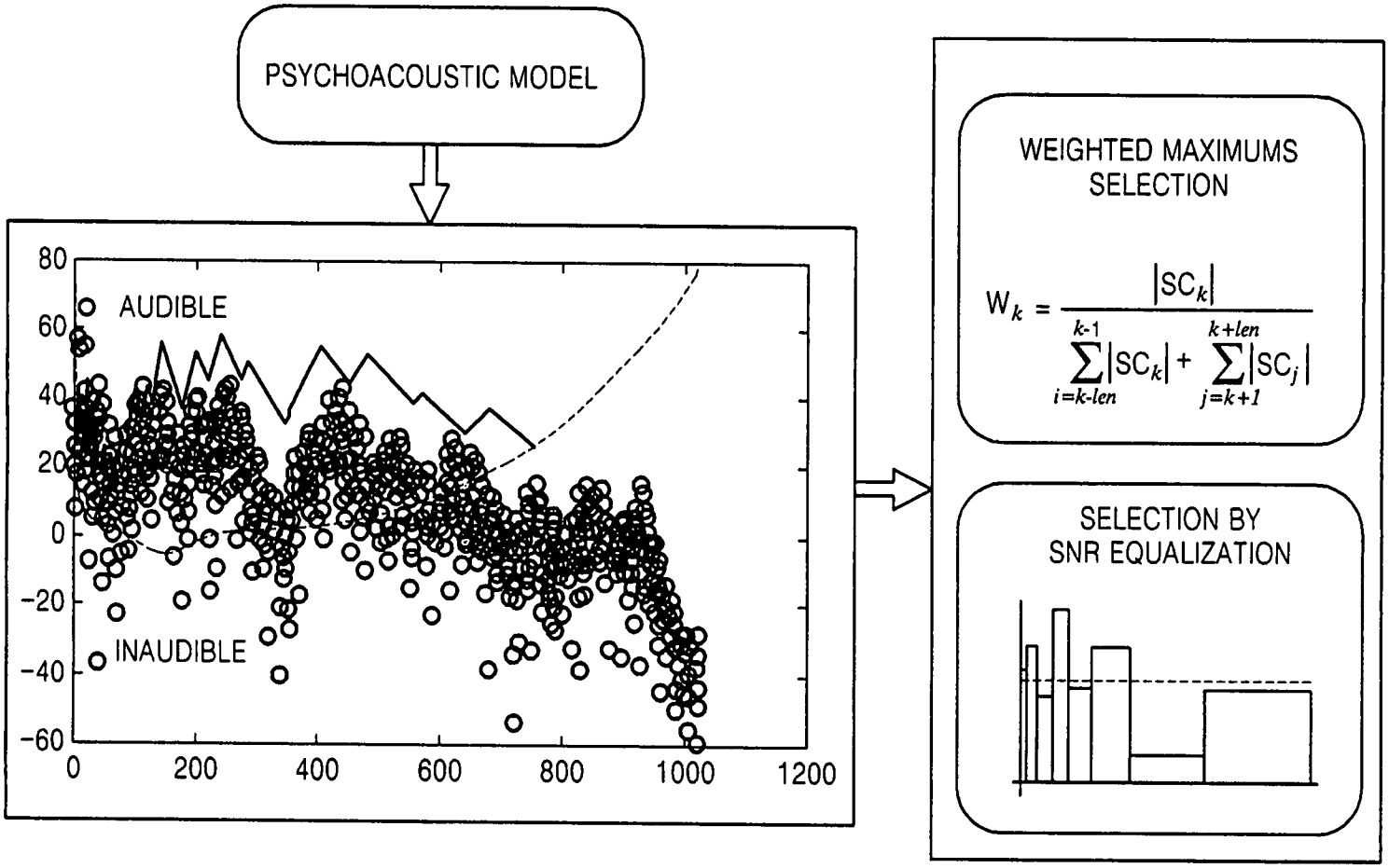
FIG. 3 is a schematic view illustrating a method of extracting an important spectral component from an input audio signal in order to compress the audio signal with a low bit-rate according to an embodiment of the present inventive concept.

FIG. 3 is a schematic view illustrating a method of extracting an important spectral component from an input audio signal in order to compress the audio signal with a low bit-rate according to an embodiment of the present general inventive concept. Referring to FIGS. 2 and 3, an input audio signal is transformed into a spectral audio signal using, for example, MDCT and MDST, and a signal-to-mask ratio (SMR) value is calculated to correspond to the transformed spectral audio signal according to a psychoacoustic characteristic of a psychoacoustic model to correspond to an audible signal and an inaudible signal. The spectral audio signal having the first, second, and/or third ISCs can be obtained according to an SNR value, a weighting factor (or a weighted maximum value) and/or SNR equalization.

Figure 4:
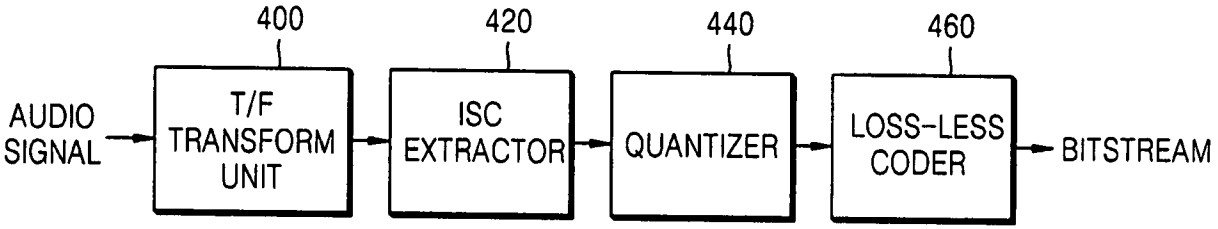
FIG. 4 is a block diagram illustrating a construction of a low bit-rate audio signal coding apparatus using apparatus to extracting an important spectral component from an input audio signal in order to compress the audio signal with a low bit-rate according to an embodiment of the present general inventive concept.

FIG. 4 is a block diagram illustrating a low bit-rate audio signal coding apparatus using an apparatus to extract important spectral component of an audio signal according to an embodiment of the present general inventive concept. The low bit-rate audio signal coding apparatus includes an ISC extractor 420, a quantizer 440, and a lossless coder 460. The low bit-rate audio signal coding apparatus may further include a T/F transformation unit 400.

Referring to FIGS. 1 and 4, the T/F transformation unit 400 transforms a temporal audio signal into a spectral signal (spectral audio signal) by using a modified discrete cosine transform (MDCT) and a modified discrete sine transform (MDST). The spectral audio signal input to the psychoacoustic model of the ISC extractor 420 is generated by using the MDCT and the MDST instead of a discrete Fourier transform (DFT). By doing so, the MDCT and the MDST represent real and imaginary parts, so that phase components of the audio signal can be additionally represented. Accordingly, the miss match problem of the DFT and the MDST can be solved. The miss match problem occurs when coefficients of the MDCT are quantized by using the temporal audio signal subject to the DFT.

The ISC extractor 420 extracts the audio signal having the ISC from the spectral audio signal. The ISC extractor 420 may be the same as the audio signal ISC extraction apparatus of FIG. 1, and thus, description thereof is omitted. That is, the ISC extractor 420 includes a psychoacoustic modeling unit 100 and an ISC selection unit 150 to select the audio signal having the ISCs.

Figure 5:
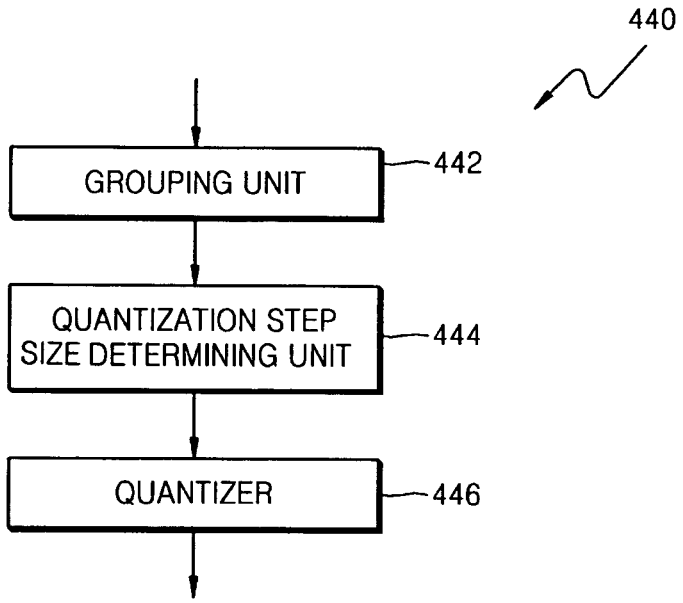
FIG. 5 is a block diagram illustrating a quantizer of the apparatus of FIG. 4.

The quantizer 440 quantizes the audio signal of the ISC. As shown in FIG. 5, the quantizer 400 includes a grouping unit 442, a quantization step size determination unit 444, and a quantizer 446.

The grouping unit 442 performs grouping so as to minimize additional information according to a used bit amount and a quantization error. The quantization for the selected ISCs is performed as follows. Firstly, the grouping is performed on the selected ISCs so as to minimize the additional information according to a rate-distortion. The Rate-Distortion represents a relation between the used bit amount and the quantization error. The used bit amount and the quantization error can be traded off. That is, if the used bit amount increases, the quantization error decreases.

On the contrary, if the used bit amount decreases, the quantization error increases. The selected ISCs are grouped, and costs of the groups are calculated. The grouping is performed so as to lower the costs.

The groups may be formed to be uniform, and may be merged so as to reduce the costs of the frequency bands. In addition, the cost is obtained by adding bit numbers required for the groups and additional information on the bit numbers as shown in Equation 2.

$$\text{cost}=q_{bit}+\text{additional information [bit number]} \qquad \text{Equation 2}$$

Here, $q_{bit}$ denotes the bit number required for each group, and the additional information includes a scale factor, quantization information, and the like.

When the grouping is completed, the quantization step size determining unit 444 determines a quantization step size according to the SMRs and data distributions (dynamic ranges) of the groups. In addition, the ISCs constituting the group are normalized with a maximum value of the ISCs.

The quantizer 446 quantizes the audio signals of the groups. The quantizer 446 is determined by using values normalized with the maximum value of the ISCs of the group and the quantization step size.

It is possible that the quantization may be Max-Lloyd quantization.

Figure 6:
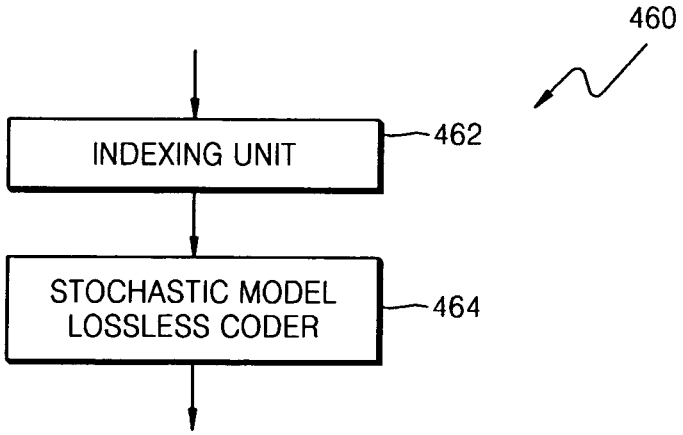
FIG. 6 is a block diagram illustrating a lossless coding unit of the apparatus of FIG. 4.

The lossless coder 460 performs the lossless coding on the quantized signal. As illustrated in FIG. 6, the lossless coder 460 includes an indexing unit 462 and a stochastic model lossless coder 464. The lossless coding may be context arithmetic coding.

The indexing unit 462 generates one or more spectral indexes to represent the spectral components constituting each frame. The spectral indexes indicate the presence of the ISCs. The spectral information of the ISCs is coded by using the context arithmetic coding. More specifically, the spectral components constituting each frame are set by the spectral index representing the selection of the ISCs. The spectral index may be a signal having 0 or 1 to represent the presence or absence of the ISCs.

The stochastic model lossless coder 464 selects a stochastic model according to a correlation to a previous frame and distribution of neighboring ISCs and performs the lossless coding on the quantization values of the audio signal and additional information including the quantizer information, the quantization step size, and the grouping information and the spectral index value. Next, bit packing is performed on the coded value.

Figure 7:
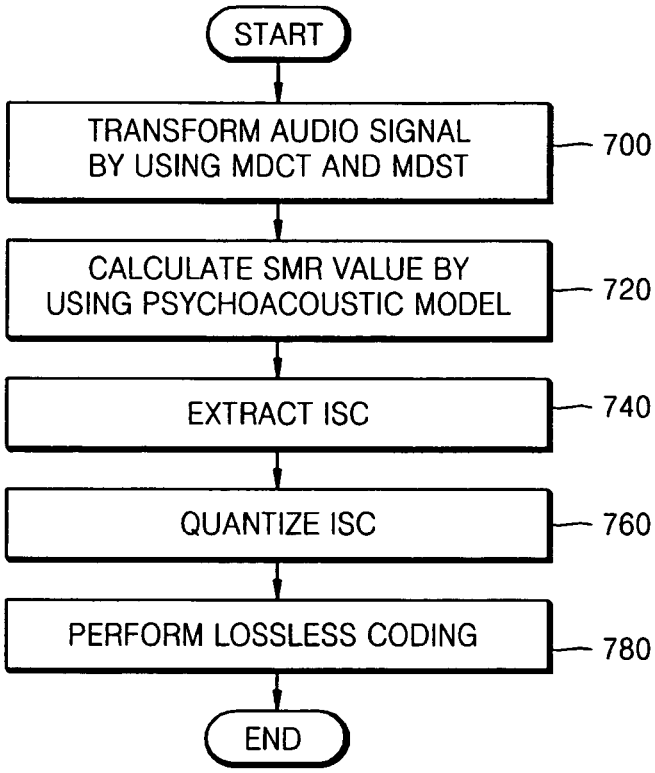
FIG. 7 is a flowchart illustrating a low bit-rate audio signal coding method using a method of extracting an important spectral component from an audio signal according to an embodiment of the present general inventive concept.

FIG. 7 is a flowchart illustrating a low bit-rate audio signal coding method using an audio signal ISC extracting method according to an embodiment of the present general inventive concept.

Referring to FIGS. 4 and 7, a temporal audio signal is transformed into a spectral signal by using a modified discrete cosine transform (MDCT) and a modified discrete sine transform (MDST) (operation 700). The transformed spectral audio signal is input to a psychoacoustic model. In the psychoacoustic model, a signal-to-mask ratio (SMR) is calculated in order to predict importance of the spectral audio signal (operation 720). The ISCs are extracted by using the SMR value (operation 740). The ISC extraction may be the same as the ISC extracting method of FIG. 2, and thus, description thereof is omitted.

Figure 8:
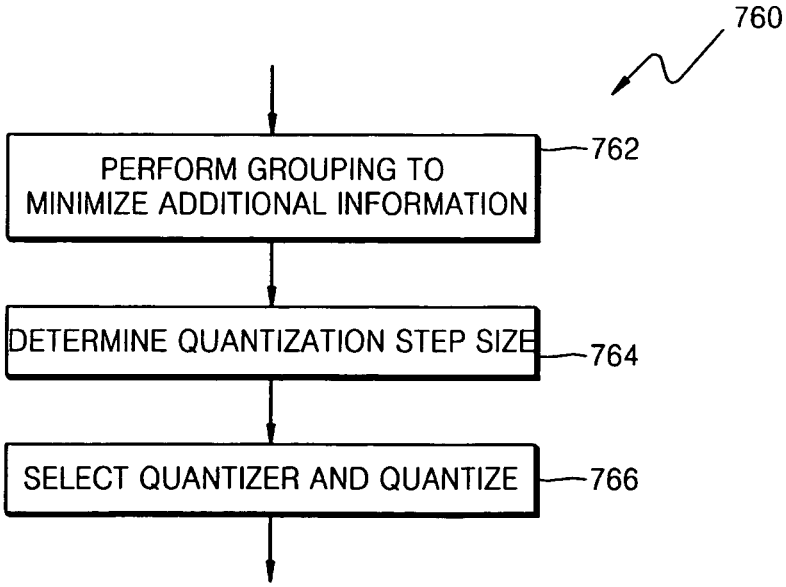
FIG. 8 is a detailed flowchart illustrating ISC quantization of the method of FIG. 7.

After the ISCs are extracted, the ISC quantization is performed (operation 760). Detailed operations of the ISC quantization are illustrated in FIG. 8. Referring to FIG. 8, the grouping is performed so as to minimize additional information according to a relation between a used bit amount and a quantization error (operation 762). The grouping may be the same as that of the grouping unit 442 of FIG. 5, and thus, description thereof is omitted.

After the grouping, a quantization step size is determined according to the SMRs and data distributions (dynamic ranges) of the groups (operation 764). In addition, the ISCs constituting the group are normalized with a maximum value of the ISCs.

Next, the quantizer is determined by using the values normalized with the maximum value of the group and the quantization step size.

It is possible that the quantization is Max-Lloyd quantization.

Referring back to FIG. 7, after the quantization, the lossless coding is performed (operation 780). The quantization value and the spectral information of the ISCs are coded through context arithmetic coding. In addition, the spectral components constituting each frame are set by the spectral index representing the selection of the ISCs. The spectral index represents the presence and absence of the ISCs with 0 and 1, respectively. Next, a value of the spectral index is coded. A stochastic model is selected according to a correlation to a previous frame and distribution of neighboring ISCs, and the lossless coding is performed. Next, bit packing is performed on the coded value.

Figure 9:
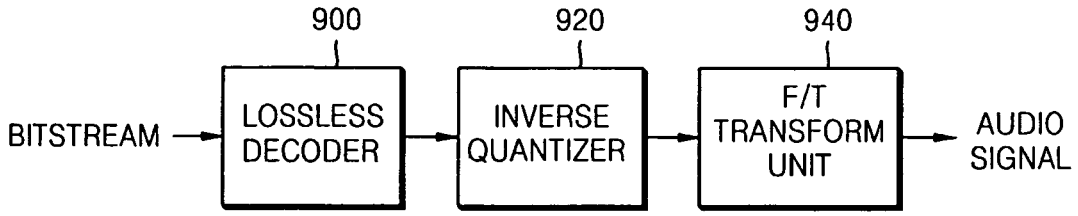
FIG. 9 is a block diagram illustrating a low bit-rate audio signal decoding apparatus to decode a coded low bit-rate audio signal by using an apparatus to extract an important component from an audio signal according to an embodiment of the present inventive concept.

FIG. 9 is a block diagram illustrating a low bit-rate audio signal decoding apparatus to decode a coded low bit-rate audio signal coded using an apparatus to extract an important spectral component of an audio signal. The low bit-rate audio signal decoding apparatus includes a lossless decoder 900, an inverse quantizer 920, and an F/T transformation unit 940.

The lossless decoder 900 extracts stochastic model information of the groups and restores index information indicating the presence of the ISCs, quantizer information, a quantization step size, ISC grouping information, and audio signal quantization values for the groups by using the stochastic model information.

The inverse quantizer 920 performs inverse quantization with reference to the restored quantizer information, quantization step size, and grouping information.

The F/T transformation unit 940 transforms the inversely-quantized values to temporal signals.

Figure 10:
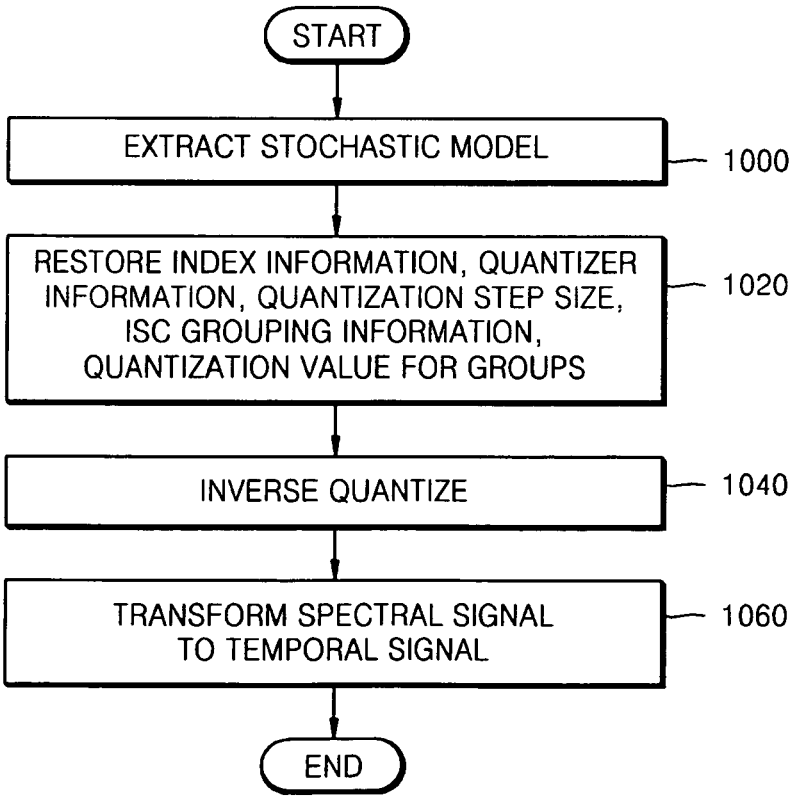
FIG. 10 is a flowchart illustrating a low bit-rate audio signal decoding method of decoding a coded low bit-rate audio signal by using an apparatus to extract an important spectral component of an audio signal according to an embodiment of the present inventive concept.

FIG. 10 is a flowchart illustrating a low bit-rate audio signal decoding method of decoding a coded low bit-rate audio signal coded using the apparatus to extract an audio signal having an ISC according to an embodiment of the present general inventive concept. Operations of the low bit-rate audio signal decoding method and apparatus will be described with reference to FIGS. 9 and 10.

Firstly, stochastic model information for frames is extracted by the lossless decoder 900 (operation 1000). Next, index information indicating the presence of the ISCs, quantizer information, a quantization step size, ISC grouping information, and audio signal quantization values are restored by using the stochastic model information (operation 1020). Next, the quantization values are inversely-quantized according to the restored quantizer information, quantization step size, and grouping information by the inverse quantizer 920 (operation 1040). After the inverse quantization, the inversely-quantized values are transformed to temporal signals by the F/T transformation unit 940 (operation 1060).

According to an method and apparatus to extract an audio signal having an ISC and a low bit-rate audio signal coding/decoding method and apparatus using the same, it is possible to efficiently code perceptual important spectral components so as to obtain high sound quality at a low bit-rate. In addition, it is possible to extract the perceptual important component by using a psychoacoustic model, to perform coding without phase information, and to efficiently represent a spectral signal at a low bit-rate. In addition, the present embodiment can be employed in all the applications requiring a low bit-rate audio coding scheme and in a next generation audio scheme.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of an audio signal coding and/or decoding system, the method comprising:

calculating, performed by at least one processing device, perceptual importance including an SMR (signal-to-mask ratio) value on transformed spectral audio signals according to a psychoacoustic model;

selecting the spectral audio signals having a masking threshold value smaller than that of the spectral audio signals according to the calculated perceptual importance as one or more first important spectral components (ISCs); and extracting a spectral peak from the audio spectral signals selected as the one or more first ISCs to select one or more second ISCs to be used to code the spectral audio signal, based on the extracted spectral peak and a predetermined weighting factor.

2. The method of claim 1, wherein the extracting of the spectral peak as the one or more second ISCs comprises obtaining the weighting factor according to a predetermined number of spectrum values near a frequency of a current signal of which weighting factor is to be obtained.

3. The method of claim 1, further comprising:

obtaining signal-to-noise ratios (SNRs) corresponding to frequency bands of the spectral audio signal; and selecting spectral components of which peak values are larger than a predetermined value among the frequency bands having a low SNR as one or more third ISCs to be used to code the spectral audio signal.

4. A method of an audio signal coding and/or decoding system, the method comprising:

calculating, performed by at least one processing device, perceptual importance including an SMR (signal-to-mask ratio) value on transformed spectral audio signals according to a psychoacoustic model;

selecting the spectral audio signals having a masking threshold value smaller than that of the spectral audio signals according to the calculated perceptual importance as one or more first important spectral components (ISCs); and obtaining signal-to-noise ratios (SNRs) corresponding to frequency bands among the spectral audio signals having the one or more first ISCs, and selecting spectral components of which peak values are larger than a predetermined value among the frequency bands having a low SNR as one or more another ISCs.

5. A low bit-rate audio signal coding method comprising:

calculating, performed by at least one processing device, perceptual importance including a signal-to-mask ratio (SMR) value on spectral audio signals according to a psychoacoustic model;

selecting the spectral audio signals having a masking threshold value smaller than that of the spectral audio signals according to the perceptual importance as one or more first important spectral components (ISCs);

extracting a spectral peak from the spectral audio signals having the one or more first ISCs and selecting a frequency of the spectral peak in consideration of a predetermined weighting factor as one or more second ISCs; and performing quantization and lossless coding on the spectral audio signals according to the one or more first and second ISCs.

6. The low bit-rate audio signal coding method of claim 5, wherein the extracting of the spectral peak comprises obtaining signal-to-noise ratios (SNRs) for frequency bands of the spectral audio signal, and selecting spectral components of which peak values are larger than a predetermined value among the frequency bands having a low SNR as one or more third ISCs.

7. The low bit-rate audio signal coding method of claim 5, wherein the calculating of the perceptual importance including the signal-to-mark ratio (SMR) value of the spectral audio signals comprises transforming a temporal audio signal into the spectral audio signals by using MDCT (modified discrete cosine transform) and MDST (modified discrete sine transform) to generate the spectral audio signals.

8. The low bit-rate audio signal coding method of claim 5, wherein the performing of the quantization of the spectral audio signals comprises:

performing grouping to form a plurality of groups so as to minimize additional information according to a used bit amount and a quantization error;

determining a quantization step size according to the SMR (signal-to-mark ratio) and data distribution of a dynamic range of groups; and quantizing the spectral audio signal by using predetermined quantizers for the groups.

9. The low bit-rate audio signal coding method of claim 8, wherein the quantizing of the spectral audio signal comprises determining the quantizers using values normalized with a maximum value of the group and the quantization step size.

10. The low bit-rate audio signal coding method of claim 8, wherein the performing of the quantization comprises performing a Max-Lloyd quantization.

11. The low bit-rate audio signal coding method of claim 8, wherein the performing of the lossless coding of the quantized signal comprises performing context arithmetic coding.

12. The low bit-rate audio signal coding method of claim 11, wherein the performing of the context arithmetic coding comprises:

generating one or more spectral indexes using spectral components constituting frames of the spectral audio signals to indicate the presence of at least one of the first and second ISCs; and selecting a stochastic model according to a correlation to a previous frame and distribution of neighboring ISCs, and performing the lossless coding on quantization values of the spectral audio signal and additional information including the quantizer information, the quantization step size, and the grouping information and the spectral index value.

13. A low bit-rate audio signal coding method comprising:

calculating, performed by at least one processing device, perceptual importance including a signal-to-mask ratio (SMR) value of spectral audio signals according to a psychoacoustic model;

selecting spectral signals having a masking threshold value smaller than that of the spectral audio signals according to the perceptual importance as one or more first ISCs;

obtaining signal-to-noise ratios (SNRs) for frequency bands among the spectral audio signals having the first ISCs, and selecting spectral components of which peak values are larger than a predetermined value among the frequency bands having a low SNR as one or more another ISCs; and performing quantization and lossless coding on the spectral audio signals having at least one of the one or more first and another ISCs.

14. An apparatus to extract a component of an audio signal, comprising:

a psychoacoustic modeling unit, implemented by at least one processing device, which calculates perceptual importance including a signal-to-mask ratio (SMR) value of transformed spectral audio signals according to a psychoacoustic model;

a first ISC selection unit which selects spectral signals having a masking threshold value smaller than that of the spectral audio signals according to the perceptual importance as one or more first important spectral components (ISCs); and a second ISC selection unit which extracts a spectral peak from the spectral audio signals selected as the first ISCs to select one or more second ISCs, based on the extracted spectral peak and a predetermined weighting factor.

15. The apparatus of claim 14, wherein the weighting factor of the second ISC selection unit is obtained by using a predetermined number of spectrum values near a frequency of a current signal of which weighting factor is to be obtained.

16. The apparatus of claim 14, further comprising:

a third ISC selection unit which obtains signal-to-noise ratios (SNRs) for frequency bands of the spectral audio signals and selects spectral components of which peak values are larger than a predetermined value among the frequency bands having a low SNR as one or more third ISCs.

17. An apparatus to extract a component of an audio signal, comprising:

a psychoacoustic modeling unit, implemented by at least one processing device, which calculates perceptual importance including a signal-to-mask ratio (SMR) value of transformed spectral audio signals according to a psychoacoustic model;

a first ISC selection unit which selects spectral signals having a masking threshold value smaller than that of the spectral audio signals using the perceptual importance as one or more first ISCs; and another ISC selection unit which obtains signal-to-noise ratios (SNRs) corresponding to frequency bands among the spectral audio signals having the one or more first ISCs, and selects spectral components of which peak values are larger than a predetermined value among the frequency bands having a low SNR as one or more another ISCs.

18. A low bit-rate audio signal coding apparatus, comprising:

a psychoacoustic modeling unit, implemented by at least one processing device, which calculates perceptual importance including an signal-to-mask ratio (SMR) value of transformed spectral audio signals according to a psychoacoustic model;

a first important spectral component (ISC) selection unit which selects spectral signals having a masking threshold value smaller than that of the spectral audio signals using the SMR value as first ISCs;

a second ISC selection unit which extracts a spectral peak from the spectral audio signals selected as the first ISCs to select second ISCs, based on the extracted spectral peak and a predetermined weighting factor;

a quantizer which quantizes the spectral audio signal corresponding to the first and second ISCs; and a lossless coder which performs lossless coding on the quantized signal.

19. The low bit-rate audio signal coding apparatus of claim 18, further comprising:

a third ISC selection unit which obtains signal-to-noise ratios (SNRs) for frequency bands of the spectral audio signals and selects spectral components of which peak values are larger than a predetermined value among the frequency bands having a low SNR as third ISCs.

20. The low bit-rate audio signal coding apparatus of claim 18, further comprising:

a T/F transformation unit which transforms a temporal audio signal into the spectral audio signals by using MDCT (modified discrete cosine transform) and MDST (modified discrete sine transform).

21. The low bit-rate audio signal coding apparatus of claim 18, wherein the quantizer comprises:

a grouping unit which performs grouping on the spectral audio signals so as to minimize additional information according to a used bit amount and a quantization error;

a quantization step size determination unit which determines a quantization step size according to a signal-to-mark ratio (SMR) and data distribution (dynamic range) of the groups of the spectral audio signals; and a quantizer which quantizes the spectral audio signal by using predetermined quantizers for the groups.

22. The low bit-rate audio signal coding apparatus of claim 21, wherein the quantizer quantizes the spectral audio signals using a Max-Lloyd quantization.

23. The low bit-rate audio signal coding apparatus of claim 21, wherein the lossless coder performs the lossless coding using context arithmetic coding.

24. The low bit-rate audio signal coding apparatus of claim 23, wherein the lossless coder comprises:

an indexing unit which generates spectral indexes using spectral components constituting frames of the spectral audio signals to indicate the presence of the first and second ISCs; and a stochastic model lossless coder which selects a stochastic model according to a correlation to a previous frame and distribution of neighboring ISCs and performs the lossless coding on quantization values of the spectral audio signal and additional information including the quantizer information, the quantization step size, and the grouping information and the spectral index value.

25. A low bit-rate audio signal coding apparatus comprising:

a psychoacoustic modeling unit, implemented by at least one processing device, which calculates perceptual importance including an SMR (signal-to-mask ratio) value of transformed spectral audio signals according to a psychoacoustic model;

a first important spectral component (ISC) selection unit which selects spectral signals having a masking threshold value smaller than that of the spectral audio signals using the perceptual importance as first ISCs;

a second ISC selection unit which obtains SNRs corresponding to frequency bands among the spectral audio signals selected as the first ISCs and selects spectral components of which peak values are larger than a predetermined value among the frequency bands having a low SNR as another ISCs;

a quantizer which quantizes the spectral audio signals having the first and another ISCs; and a lossless coder which performs lossless coding on the quantized signal.

26. A low bit-rate audio signal decoding method comprising:

restoring, performed by at least one processing device, index information indicating the presence of importance spectral components (ISCs), quantizer information, a quantization step size, ISC grouping information, and audio signal quantization values with respect to an audio signal;

performing inverse quantization on the audio signal according to the restored quantizer information, quantization step size, and grouping information; and transforming the inversely-quantized signals to temporal signals, wherein the ISC grouping information is obtained by performing grouping of the ISCs to form a plurality of groups so as to minimize additional information according to a used bit amount and a quantization error.

27. The low bit-rate audio signal decoding method of claim 26, further comprising:

performing lossless decoding on the index information indicating the presence of the ISCs, the quantization step size, and the ISC grouping information by using stochastic model information predicted for frames of the audio signal.

28. The low bit-rate audio signal decoding method of claim 26, further comprising:

performing lossless decoding on the index information indicating the presence of the ISCs, the quantization step size, and the ISC grouping information by using a predetermined stochastic model.

29. The low bit-rate audio signal decoding method of claim 26, the restoring of the ISCs comprises:

decoding the ISCs; and mapping the decoded ISCs to a spectral axis by using the index information indicating the presence of the ISCs.

30. A low bit-rate audio signal decoding apparatus comprising:

a lossless decoder, implemented by at least one processing device, which extracts stochastic model information for frames of an audio signal and restores index information indicating the presence of ISCs (importance spectral components), quantizer information, a quantization step size, ISC grouping information, and audio signal quantization values by using the stochastic model information;

an inverse quantizer which performs inverse quantization on the audio signal according to the restored quantizer information, quantization step size, and grouping information; and an F/T transformation unit which transforms the inversely-quantized signal to temporal signals, wherein the ISC grouping information is obtained by performing grouping of the ISCs to form a plurality of groups so as to minimize additional information according to a used bit amount and a quantization error.

31. The low bit-rate audio signal decoding apparatus of claim 30, wherein the lossless decoder performs lossless decoding on the index information indicating the presence of the ISCs, the quantization step size, and the ISC grouping information by using stochastic model information predicted for the frames of the audio signal.

32. The low bit-rate audio signal decoding apparatus of claim 30, wherein the lossless decoder performs lossless decoding on the index information indicating the presence of the ISCs, the quantization step size, and the ISC grouping information by using a predetermined stochastic model.

33. The low bit-rate audio signal decoding apparatus of claim 30, wherein the lossless decoder decodes the ISCs, and the decoded ISCs are mapped to a spectral axis by using the index information indicating the presence of the ISCs.

34. A non-transitory computer-readable medium having embodied thereon a computer program to perform a method comprising:

calculating perceptual importance including an SMR (signal-to-mask ratio) value of transformed spectral audio signals according to a psychoacoustic model;

selecting spectral signals having a masking threshold value smaller than that of the spectral audio signals as one or more first important spectral components (ISCs); and extracting a spectral peak from the audio signals selected as the one or more first ISCs to select one or more second ISCs to be used to code the spectral audio signal, based on the extracted spectral peak and a predetermined weighting factor.

35. A non-transitory computer-readable medium having embodied thereon a computer program to perform a method comprising:

restoring index information indicating the presence of importance spectral components (ISCs), quantizer information, a quantization step size, ISC grouping information, and audio signal quantization values with respect to an audio signal;

performing inverse quantization on the audio signal according to the restored quantizer information, quantization step size, and grouping information; and transforming the inversely-quantized signals to temporal signals, wherein the ISC grouping information is obtained by performing grouping of the ISCs to form a plurality of groups so as to minimize additional information according to a used bit amount and a quantization error.

36. A low bit-rate audio signal coding apparatus comprising:

a grouping unit, implemented by at least one processing device, which performs grouping on spectral audio signals so as to minimize additional information according to a used bit amount and a quantization error;

a quantization step size determination unit which determines a quantization step size according to a signal-to-mask ratio (SMR) and data distribution (dynamic range) of the groups of the spectral audio signals; and a quantizer which quantizes the spectral audio signal by using predetermined quantizers for the groups.

* * * * *